US011466531B2

(12) United States Patent
Kjøsnes et al.

(10) Patent No.: US 11,466,531 B2
(45) Date of Patent: Oct. 11, 2022

(54) JARRING DEVICE AND METHOD

(71) Applicant: Equinor Energy AS, Stavanger (NO)

(72) Inventors: Ivar Kjøsnes, Trondheim (NO); Håvard Nasvik, Vikhammer (NO)

(73) Assignee: EQUINOR ENERGY AS, Stavanger (NO)

( * ) Notice: Subject to any disclaimer, the term of this patent is extended or adjusted under 35 U.S.C. 154(b) by 65 days.

(21) Appl. No.: 16/970,213

(22) PCT Filed: Feb. 21, 2019

(86) PCT No.: PCT/NO2019/000004
§ 371 (c)(1),
(2) Date: Aug. 14, 2020

(87) PCT Pub. No.: WO2019/164404
PCT Pub. Date: Aug. 29, 2019

(65) Prior Publication Data

US 2021/0140259 A1 May 13, 2021

(30) Foreign Application Priority Data

Feb. 21, 2018 (GB) ..... 1802823

(51) Int. Cl.
*E21B 31/107* (2006.01)
*E21B 31/00* (2006.01)

(52) U.S. Cl.
CPC ..... *E21B 31/107* (2013.01); *E21B 31/005* (2013.01)

(58) Field of Classification Search
CPC ..... E21B 31/107
See application file for complete search history.

(56) References Cited

U.S. PATENT DOCUMENTS

| | | | |
|---|---|---|---|
| 1,870,540 | A | 8/1932 | Wells |
| 3,557,875 | A | 1/1971 | Solum et al. |
| 3,923,099 | A | 12/1975 | Brandon |
| 5,273,114 | A | 12/1993 | Wicks, III et al. |
| 5,361,830 | A | 11/1994 | Wicks, III et al. |
| 5,836,389 | A | 11/1998 | Wagner et al. |

(Continued)

FOREIGN PATENT DOCUMENTS

| | | |
|---|---|---|
| GB | 2461639 | 1/2010 |
| SU | 1492019 | 7/1989 |
| WO | 02/33217 | 4/2002 |

OTHER PUBLICATIONS

International Search Report dated May 7, 2019 in International (PCT) Application No. PCT/NO2019/000004.

(Continued)

*Primary Examiner* — Robert E Fuller
(74) *Attorney, Agent, or Firm* — Wenderoth, Lind & Ponack, L.L.P.

(57) ABSTRACT

In a jarring device and method for applying an impact to a casing of a wellbore in a subterranean or subsea formation, the jarring device includes a hammer and a driving means for driving the hammer between a first position in which the hammer is spaced from the casing, and a second position in which the hammer contacts the casing, such that the driving means is operable during use to drive the hammer from the first position to the second position so as to impact the casing. The hammer is reciprocated by the driving means.

18 Claims, 6 Drawing Sheets

(56) References Cited

U.S. PATENT DOCUMENTS

| | | | | |
|---|---|---|---|---|
| 6,257,356 | B1 * | 7/2001 | Wassell | E21B 7/06 166/66.5 |
| 6,725,923 | B1 | 4/2004 | Ivannikov et al. | |
| 2005/0006146 | A1 | 1/2005 | Mody et al. | |
| 2010/0006290 | A1 | 1/2010 | Saylor, III et al. | |
| 2012/0285686 | A1 | 11/2012 | Xu | |
| 2014/0284055 | A1 | 9/2014 | Xu et al. | |
| 2016/0356111 | A1 | 12/2016 | Castillo et al. | |

OTHER PUBLICATIONS

GB Examination Report dated Apr. 9, 2020 in GB Application No. 1802823.3.

GB Search Report dated Jun. 25, 2018 in GB Application No. 1802823.3.

* cited by examiner

JARRING DEVICE AND METHOD

The invention relates to a jarring device and method, particularly to a jarring device and method for applying an impact to a casing of a wellbore.

In a typical oil well, a drilled wellbore runs from the surface to a subterranean or subsea formation or hydrocarbon reservoir. A casing is inserted into the wellbore to line it and create a passageway between the reservoir and a wellhead at the surface. The casing may be surrounded by cement to hold it in place, or it may become surrounded by sagged mud, and/or formation creep over time. It can therefore be difficult to remove the casing, e.g. at the end of its life, since it may be held in place by the surrounding material.

Removal of the casing typically then requires large pulling forces to overcome high static friction forces between the casing and the surrounding material. One way to more easily pull the casing from the wellbore is to cut the casing in to shortened sections, thereby reducing the force needed to pull a smaller section. However, this approach can be very time consuming and expensive.

It is known to apply transverse vibrations to the casing of a wellbore, for example using a device as described in U.S. Pat. No. 6,725,923 B1, which comprises a hammer or hammers suspended in the wellbore on a flexible suspension support, and which is moved axially within the casing to create transverse vibrations. The transverse vibrations are used for freeing stuck pipes for running into a wellbore. However, the usefulness of vibrators and the like is limited as they generate relatively small forces in order to avoid damaging the casing.

SUMMARY OF INVENTION

According to a first aspect of the invention there is provided a jarring device for applying an impact to a casing of a wellbore in a subterranean or subsea formation, the jarring device comprising: a hammer and a driving means for driving the hammer between a first position in which the hammer is spaced from the casing and a second position in which the hammer contacts the casing, such that the driving means is operable during use to drive the hammer from the first position to the second position so as to impact the casing; wherein the hammer is reciprocated by the driving means.

The jarring device may therefore be used to apply an impact to the casing via the hammer when the driving means operates to drive the hammer from the first position to the second position. The jarring device may be used during removal of the casing from a wellbore. The jarring device may be used as a high energy lateral percussion hammer to apply high radial impact and/or vibration forces to a casing to help free it from surrounding material. The jarring device may supply sufficient energy to break up cement, sagged mud and/or formation creep so that static friction forces on the casing are reduced and less pulling force is needed to remove the casing from a wellbore. As a result, longer casing sections can be pulled, and fewer casing cuts, if any, may be needed. Since fewer cuts may be needed, the casing can be removed more quickly and the device used to reduce the time needed to pull casing sections. Further, since fewer drill string trips into the wellbore may be needed, the jarring device may also reduce health, safety and environmental risks.

The jarring device may be disposed on a string within a casing of a wellbore. Actuation of the driving means will cause the hammer to move from the first position so as to strike the casing. The driving means may be arranged to impact or strike the hammer and thereby drive it from the first position to the second position by an instantaneous force. The driving means may catapult the hammer from the first position to the second position. The driving means may be arranged to contact the hammer for a short period of time and accelerate it during that contact so as to throw or launch the hammer to the second position. The hammer may be spaced from the driving means in the second position so that it is not contacting the driving means when it strikes the casing.

The driving means may be any suitable actuator that drives the hammer and forces it to move from the first position to the second position. The driving means may drive the hammer in substantially linear movement, which in use may be transverse to a longitudinal direction of the wellbore. The driving means may be mechanical, propelling the hammer by direct physical contact therewith. The hammer is reciprocated by the driving means, and the driving means may comprise a hydraulic or electromechanical device, and/or may comprise a piston or the like, or any actuation means arranged to drive the hammer so as to impact the casing. The second position of the hammer may be directly radially outward of the first position—e.g. with respect to a longitudinal axis of the casing. The hammer may not move in an axial direction between the first and second positions. The impact may therefore be a radial or lateral force on the casing. The hammer may be adjacent and/or contacting the string in the first position.

The jarring device may comprise a body and the hammer may move relative to the body when it is driven from the first position to the second position. The hammer may be reciprocated relative to the body. The body may support the hammer. The body may be in the form of a sleeve, which may be as described herein. Viewed from another aspect the invention provides a jarring device for applying an impact to a casing of a wellbore in a subterranean or subsea formation, the jarring device comprising: a body supporting a hammer and a driving means for driving the hammer relative to the body between a first position in which the hammer is spaced from the casing and a second position in which the hammer contacts the casing, such that the driving means is operable during use to drive the hammer from the first position to the second position so as to impact the casing.

The distance between the first and second positions may be determined based on the size of the casing. The jarring device may be sized for running in the wellbore with a clearance between the jarring device and the casing that may allow the hammer to travel a sufficient distance to achieve the speed necessary to optimize its momentum for impact with the casing. As an example, the hammer may travel between 1 mm and 100 mm, or between 1 mm and 40 mm, depending on the size of the casing.

The driving means may be a shunt, which may drive the hammer by mechanical impact therewith. The shunt may be any device that impacts the hammer to force it from the first position to the second position.

The jarring device may comprise a rotatable inner shaft. The shunt may be supported by the inner shaft. The inner shaft may be arranged such that rotation thereof causes rotation of the shunt thereabout to cause the shunt to drive the hammer from the first position to the second position.

The jarring device may comprise a sleeve disposed about the rotatable inner shaft. The hammer may be supported by the sleeve. The hammer may contact the sleeve in the first position. The inner shaft and/or the sleeve may be coupled to a string for running the jarring device within the wellbore.

The sleeve may be stationary with respect to the casing during use, so that the inner shaft may rotate with respect to the sleeve and the casing. The hammer may be stationary in the first position and the shunt may be rotated so as to contact it. The shunt may be an eccentric disc or eccentric wheel disposed on the inner shaft, so that part of the eccentric disc protrudes radially outward of the inner shaft more than other parts of the disc. In this way, rotation of the inner shaft may cause a protrusion of the eccentric disc to rotate about the string and come into contact the hammer in the first position at a predetermined angular position within the casing.

The hammer may be carried by the sleeve, and may be disposed within an opening in the sleeve in the first position. The driving means may be disposed within the sleeve and may be operable to drive the hammer from the opening to the casing in the second position.

The protrusion of the eccentric disc of the shunt may take any suitable form required to strike or throw the hammer. The eccentric disc may comprise a sector that has increasing radius with angle so as to form a ramp or wedge. Then as the eccentric disc is rotated, the ramp may contact the hammer and accelerate it so as to throw the hammer to the second position. The shunt may comprise a plurality of protrusions so that the hammer may be driven a plurality of times by each full rotation (i.e. 360 degrees) of the shunt.

The rotation of the shunt may be powerful enough and/or fast enough to drive the hammer against the casing with sufficient force to break up cement or other fill surrounding the casing. To allow the movement of the shunt with respect to the hammer, the hammer may not be connected to the inner shaft, and the shunt may not be connected to the sleeve. The rotation of the shunt may be powerful enough and/or fast enough to drive the hammer against the casing with sufficient force to deform or break the casing.

The jarring device may comprise a biasing mechanism arranged to bias the hammer to the first position and to return the hammer to the first position from the second position. Then the driving means may be operable again to move the hammer from the first position to the second position to apply another impact to the casing. In this way, the hammer may be repeatedly driven back and fore between the first and second positions to apply repeated impacts to the casing. That is, the biasing mechanism may reset the position of the hammer after a first impact ready for a second impact. The biasing mechanism may comprise recoil springs and dampers arranged to return the hammer to the first position, and may do so in a damped manner to reduce impact of the hammer with the sleeve. The biasing mechanism may be connected to the sleeve. The biasing mechanism may be arranged to provide a predetermined power and rate of the hammer's impact with the casing and/or the sleeve.

If the shunt comprises a single protrusion for driving the hammer, the shunt may undergo a complete rotation about the inner shaft in order to contact the hammer again, after the hammer has been returned from the second position to the first position by the biasing mechanism. The biasing mechanism may therefore be arranged to return the hammer by the time the shunt has undergone a full rotation. If the shunt comprises a plurality of protrusions, the biasing mechanism may be arranged to return the hammer to the first position in time for the next protrusion to drive it again.

The hammer may be a first hammer and the jarring device may comprise a second hammer movable between a first position in which the second hammer is spaced from the casing and a second position in which the second hammer contacts the casing. The second hammer may comprise any and all of the features of the first hammer. The second hammer may be arranged to contact the casing at a different position to the first hammer, so that each hammer has its own first and second positions. The second hammer may operate in substantially the same manner as the first hammer, being driven by a driving means.

The second hammer may be driven by the same driving means as drives the first hammer. Where the driving means is a shunt which rotates about the string, the second hammer may be disposed on an opposite side of the string to the first hammer so that the shunt drives the second hammer half a rotation (i.e. 180 degrees) after driving the first hammer. The second hammer may therefore impact the casing on an opposite side to that of the first hammer. Alternatively, the second hammer may be disposed at any suitable angle around the string from the first hammer. The first and second hammers may be driven by a shunt comprising a plurality of protrusions, each protrusion being as described herein.

A plurality of hammers may be provided and may be driven by the same driving means. Each hammer may be spaced circumferentially about the string and each may be arranged to be driven by the same shunt during rotation thereof about the inner shaft. The hammers may be evenly spaced about the circumference of the jarring device. If the shunt comprises a single protrusion the hammers may be driven sequentially as the shunt rotates to each of them in term. If the shunt comprises a plurality of protrusions, the protrusions having the same circumferential spacing as the hammers, then the hammers may be driven simultaneously. The shunt may comprise a protrusion for each hammer so that all hammers associated with the shunt are driven at once. The hammers may be driven by the shunt in any suitable order and frequency. The driving sequence of the hammers may be predetermined for a given arrangement.

The driving means may drive a first hammer and a second hammer, and the second hammer may be arranged on an opposite side of the string to the first hammer. The driving means may comprise a shunt comprising an eccentric disc with a protrusion so that it first drives the first hammer, and then rotates 180 degrees to drive the second hammer. A connecting means (for example a connecting rod or rods) may connect the first and second hammers so that they move synchronously and in the same direction. Thus, when either of the first hammer or second hammer is driven by the driving means, the other of the first hammer and second hammer will move in the same way. Then each hammer may be movable to a third position in which the hammer is further from the second position than is the first position. This arrangement uses the movement of two hammers for each impact on the casing. Although only one of the hammers impacts the casing, the momentum of both is applied to it through whichever of the hammers was driven by the driving means.

The jarring device may comprise a plurality of stages, each stage comprising a driving means and at least one hammer, as described above in relation to the first aspect of the invention. Each stage may comprise a driving means and a plurality of hammers, as described in the preceding paragraphs. The stages may be disposed along a string, and hence axially separated along the length of the wellbore when the jarring device is in the casing.

That is, the driving means may be a first driving means of a first stage and the device may comprise a second driving means of a second stage operable to move an associated hammer from its first position to its second position. The second driving means may comprise any and all of the features of the first driving means. The second driving means may be axially spaced from the first driving means so that it is arranged above or below the first driving means when disposed in the wellbore. The associated hammer of the second driving means may be disposed at a different angle about jarring device to that of the first hammer of the first stage. Alternatively, the second stage hammer may be disposed at the same angle as the first hammer. The second driving means may drive a plurality of hammers, as described above.

The jarring device may therefore comprise a plurality of hammers and driving means in a plurality of stages. Each stage, and hence each driving means, may be axially spaced from the others along the length of the wellbore. There may be one hammer and driving means for each stage, or there may be a plurality of hammers and a driving means as described above for each stage. The hammers may be disposed about the jarring device with equal angles between neighbouring hammers. Where multiple hammers are provided in the same stage and at the same axial position on the jarring device, they may be evenly spaced thereabout, or may have irregular spacing. The driving means in each stage may be arranged so that the hammers are driven simultaneously, or sequentially. Where a plurality of hammers is provided, some may be driven simultaneously and some may be driven sequentially. The hammers may be driven in any order and at any rate as desired.

The jarring device may comprise four stages, each stage comprising a hammer paired with a driving means. Each stage may be evenly spaced along the length of the jarring device and each hammer may be evenly spaced about its circumference. In this embodiment, the hammers may be driven in sequence so that after the uppermost hammer is driven, the one immediately below it is driven and so on. The jarring device may comprise eight stages, each stage comprising a hammer paired with a driving means. Each stage may be evenly spaced along the length of the jarring device and each hammer may be rotated by about 90° about the circumference of the jarring device with respect to its neighboring stage(s).

The jarring device may comprise a hydraulic motor for rotating the inner shaft. The hydraulic motor may be powered by pumping well fluid therethrough. The jarring device may comprise an electric motor for rotating the inner shaft. Alternatively the inner shaft may be rotated by a conventional mechanism at the surface.

As used herein, the term hammer relates to a massive body, the purpose of which is to move so as to impact another object and apply a percussive force thereto. The hammer may have a predetermined mass suitable for use in a given arrangement. The mass may be sufficient to provide a crushing impact to material surrounding the casing when driven by the driving means. The hammer mass may be optimized to give the required momentum for impact with the casing wall. The jarring device may be arranged to drive the hammer with a predetermined speed sufficient for a given arrangement. The impact may be sufficient to crack cement on the outside of the casing without going beyond the yield strength of the casing. Larger casings may have larger yield strengths and hence may allow more forceful hammer impacts upon the casing. The jarring device used in larger casings may have fewer hammers than for small casings since the energy available to the jarring device may be limited.

The retardation time of the hammer may be predetermined for a particular situation. In a stiff mechanical construction such as a cemented casing the retardation time of the hammer may be as low as 0.001 seconds, and may be non-elastic.

The shunt may be arranged to rotate at between 30 to 180 revolutions per minute (rpm), and may be arranged to rotate at about 60 revolutions per minute. The frequency of impacts for any hammer may be one per full revolution of the shunt. Then, at 60 rpm a hammer will impact the casing once every second. The impact frequency can be regulated using a variable hydraulic or electric motor to drive the shunt.

The jarring device may be arranged such that the hammer is operable to impact the casing with a force greater than about 100,000 Newtons (kgm/s$^2$), or greater than about 200,000 Newtons, or greater than about 250,000 Newtons. The hammer may have a mass of between 1 kg and 50 kg, and may be about 25 kg. The hammer may move at a speed of about 10 meters per second when driven by the driving means. The impact may be a non-elastic impact of about 250,000 N (kgm/s$^2$) with the casing. The hammer may travel a distance in the range of about 30 to 40 mm to achieve the recited force. Other masses, forces and travel distances may be used and may be determined on a case-by-case basis for each wellbore and casing. The impacts may be sufficient to permanently deform, crack, and/or break the casing. The forces may be greater than those of vibrators.

The jarring device may be operable as a vibrator, and hence may be used in place of known vibrators e.g. for placing casings or freeing casings from surrounding material and/or fill. The jarring device may be arranged such that the hammer is operable to impact the casing to vibrate it but not to damage it and/or break material surrounding it.

According to a second aspect of the invention there is provided an apparatus for removing a casing from a wellbore comprising a jarring device as described with respect to the first (or any) aspect of the invention, and further comprising a spear or slips disposed on a string above the jarring device.

The spear or slips may be a conventional device and may be arranged to hold the string within the casing to allow pulling of the casing via the string. The spear or slips may fix the string at an axial position within the casing but may allow rotation of the string about its longitudinal axis. Such an apparatus may be used to apply a pulling force to the casing at the same time as applying impacts thereto using the jarring device. As such, it may be used to remove casing from a wellbore. The jarring device may be powerful enough to break up material surrounding the casing as described above, and so the apparatus may be used to pull longer sections of casing than has previously been possible.

The apparatus may comprise a longitudinal jarring device which may be arranged to provide a jarring force along the string in a longitudinal direction. The longitudinal jarring device may be disposed on the string or may be above the surface. The longitudinal jarring device may be a conventional hammer device, and may be arranged to operate simultaneously with the jarring device of the present invention. In this way, the casing may be jarred in both radial and longitudinal directions simultaneously to help reduce the force needed to pull the casing from the wellbore.

The apparatus may comprise a cutting means such as a casing cutter disposed below the jarring device of the first aspect. The casing cutter may be used to cut the casing so that small casing sections may be pulled.

The apparatus may comprise a controller for controlling operation of the jarring device. The controller may be operable to change the frequency of impacts of the jarring device, for example by controlling the speed or rotation of the driving means and hence how often it drives the hammer.

The apparatus may comprise sensors or instruments for monitoring the operation of the jarring and for providing feedback to the controller. For example, the apparatus may comprise instruments for mud pulse telemetry or intelligent pipe solutions.

The apparatus may comprise a vibrator for providing vibration forces and further reducing the force needed to pull casing sections from the wellbore. The vibrator may be a conventional vibrator, and may be disposed between the spear/slips and the jarring device of the first aspect. The apparatus may comprise an emergency release integrated with the jarring device.

According to a third aspect of the invention there is provided a method of applying an impact to a casing of a wellbore in a subterranean or subsea formation, the method comprising: positioning a jarring device within the casing, the jarring device comprising a hammer and a driving means for driving the hammer between a first position in which the hammer is spaced from the casing and a second position in which the hammer contacts the casing; and operating the driving means to drive a hammer from the first position to the second position to apply an impact to the casing; wherein the hammer is reciprocated by the driving means.

The step of operating the driving means may comprise operating a shunt to rotate the shunt about an inner shaft of the string to cause the shunt to drive the hammer from the first position to the second position. The second position may be directly radially outwards of the first position and the impact may therefore be a lateral impact.

The method may comprise repeatedly applying impacts to the casing by driving the hammer repeatedly. The method may comprise apply impacts to the casing sequentially by a plurality of hammers. The method may comprise changing the frequency of impacts by changing how frequently the hammer is driven by the driving means, and may comprise changing the speed of rotation of the shunt about an inner shaft.

The method may comprise using the jarring device as a vibrator, and may comprise applying an impact to the casing without damaging the casing and/or without breaking or damaging material surrounding the casing e.g. without breaking cement.

The method may comprise using a jarring device as described above in relation to the first aspect of the invention or an apparatus as described above in relation to the second aspect of the invention. The method may comprise using a jarring device as described in relation to any aspect of the invention.

According to a fourth aspect of the present invention there is provided a method of removing a casing from a wellbore in a subterranean or subsea formation, the method comprising: applying an impact to the casing using a method as described above in relation to the third aspect of the invention; and applying a force to the casing to pull it from the wellbore.

The step of applying a force to the casing to pull it from the wellbore may comprise applying a longitudinal (along the axis of the casing) or an upward force. It may comprise applying an upward jarring force using a jarring hammer oriented in the longitudinal direction of the casing. The jarring hammer may be disposed outside of the casing and may be above the surface. Other pulling forces may be used and the method may comprise applying any longitudinal force to the casing simultaneously with the radial/lateral impact forces caused by the jarring device of the first aspect.

The method may comprise setting a spear or slips within the casing to provide an anchor for the string therein and to provide purchase for applying longitudinal forces on the casing via the string.

The method of the third or fourth aspect of the invention may comprise breaking up material surrounding the casing. The material may be cement. The method may comprise freeing the casing from the surrounding material.

The method of the third or fourth aspect may comprise, after applying an impact to the casing, moving the jarring device within the casing to applying an impact to another part of the casing. In this way, the jarring device may be used to break up material surrounding the casing over a length of the casing greater than the length of the jarring device. Accordingly, a large portion of the casing may be freed from surrounding material to be moved.

The method may comprise cutting the casing to reduce the length of casing to pull at one time. Wellbore casing is typically provided in sections each of a predetermined length e.g. approximately 10 meters. The method may comprise pulling multiple sections of casing simultaneously, and may comprise pulling casing have a total length of greater than 50 meters, or preferably greater than 200 meters.

The method steps described above may be carried out in any suitable order for achieving their intended purpose of removing a casing from a wellbore.

According to another aspect of the invention there is provided a jarring device for applying an impact to a casing of a wellbore in a subterranean or subsea formation, the jarring device comprising: a hammer and a driving means for driving the hammer between a first position in which the hammer is spaced from the casing and a second position in which the hammer contacts the casing, such that the driving means is operable during use to drive the hammer from the first position to the second position so as to impact the casing.

According to another aspect of the invention there is provided a method of applying an impact to a casing of a wellbore in a subterranean or subsea formation, the method comprising: positioning a jarring device within the casing, the jarring device comprising a hammer and a driving means for driving the hammer between a first position in which the hammer is spaced from the casing and a second position in which the hammer contacts the casing; and operating the driving means to drive a hammer from the first position to the second position to apply an impact to the casing.

BRIEF DESCRIPTION OF THE DRAWINGS

Certain embodiments of the invention are described below, by way of example only, and with reference to the accompanying drawings in which.

DETAILED DESCRIPTION OF THE INVENTION

Figure 1:
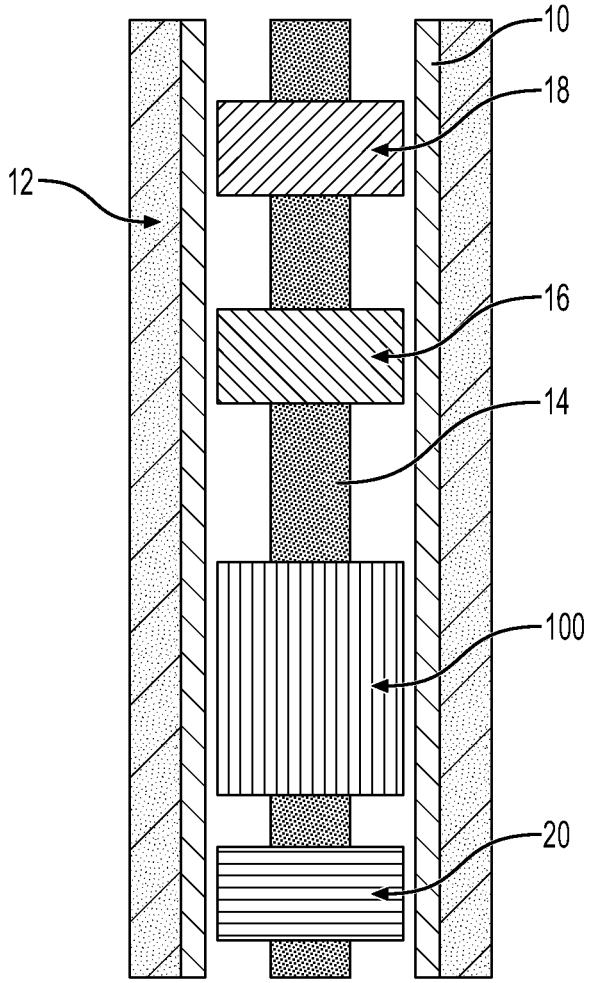
FIG. 1 is a schematic view of an apparatus for removing casing from a wellbore comprising a jarring device according to the present invention.

FIG. 1 shows a schematic depiction of a jarring device 100 in a wellbore in a subterranean formation. The wellbore is defined within the formation and is lined by a casing 10 along its length. The casing is surrounded by fill 12 such as cement and/or other material. The jarring device 100 is disposed on a string 14 within the casing 10. Also disposed on the string 14, above the jarring device 100, is a spear 16 which may be deployed into the casing 10 to fix the string 14 at a position within the casing 10. A longitudinal jar 18 is provided for applying jarring forces in the longitudinal direction of the string 14. A casing cutter 20 is also provided and may be used to cut the casing 10 to reduce the length of casing 10 to be pulled.

In use, the jarring device 100 is used to apply impact and vibrational forces to the casing 10 in a lateral (e.g. radial) direction. These forces will break up the fill 12 (e.g. cement and/or other material) surrounding the casing 10 in the region of the jarring device 100. The jarring device 100 may be run along a length of the casing 10 the break up the fill 12 around that length and may make pulling the casing 10 from the wellbore easier.

The casing cutter 20 is then used to cut the casing 10, and the spear 16 is engaged to anchor the casing 10 to the string 14. The string 14 is then pulled in order to pull the casing 10 from the wellbore. The jar 18 may be operated to apply longitudinal jarring forces to the string 14 to help dislodge the casing 10 from the surrounding fill 12 and remove the casing 10 from the wellbore. The jarring device 100 may also be operated to apply lateral forces to the casing 10 and help reduce the friction on the casing 10 from the surrounding fill 12 and further reduce the force needed to pull the length of casing 10 from the wellbore.

Figure 2:
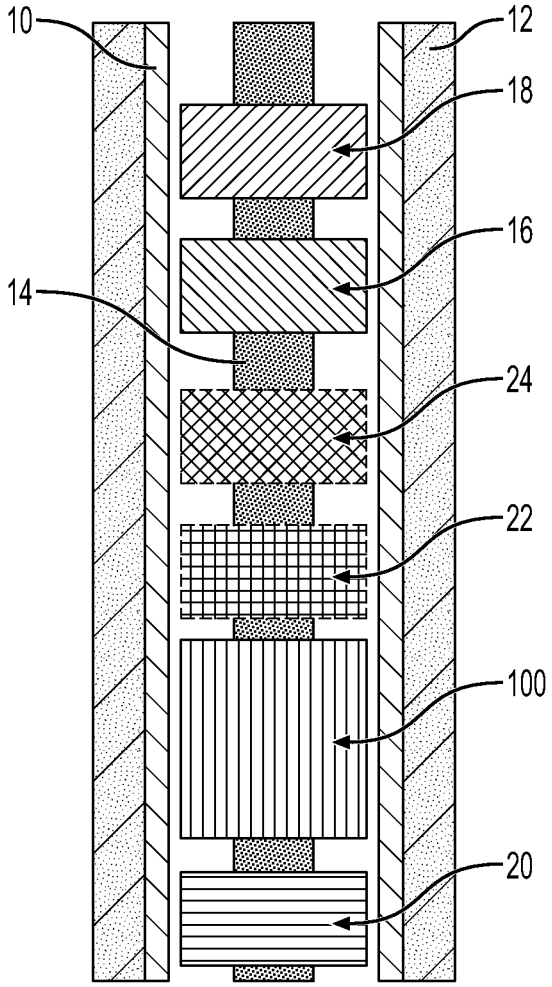
FIG. 2 is a schematic view of an apparatus for removing casing from a wellbore comprising a jarring device according to the present invention.

FIG. 2 shows a similar apparatus as that of FIG. 1, but further comprising a vibrator 22 and another suitable component 24. The vibrator 22 may be operated while pulling on the casing 10 to help loosen the casing 10 from the surrounding fill 12. The vibrator 22 applies much smaller forces than does the jarring device 100.

Figure 3:
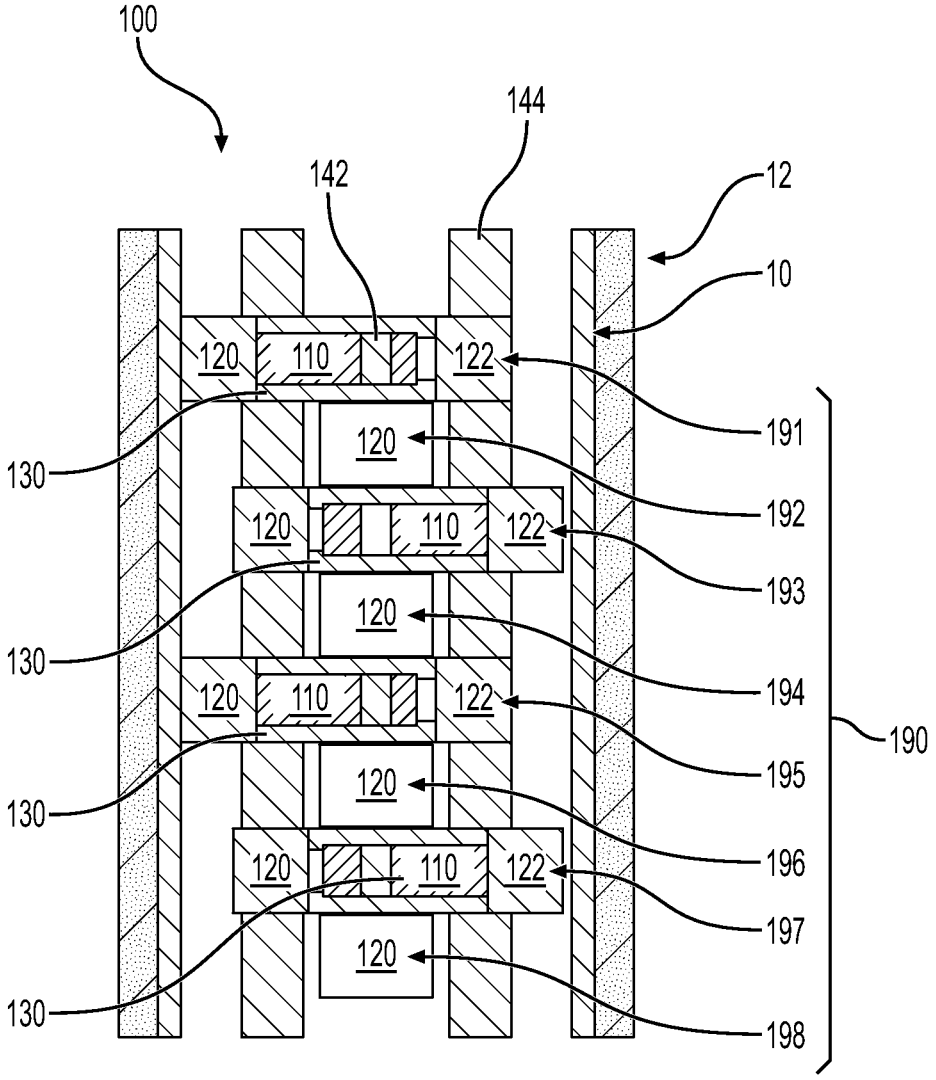
FIG. 3 is a schematic view a jarring device according to the present invention.

FIG. 3 shows a schematic view of a jarring device 100. The jarring device 100 is disposed in the casing 10 and comprises a plurality of stages 190, comprising a first stage 191 to an eighth stage 198. Each stage 190 comprises a driving means in the form of a shunt 110, a first hammer 120 and a second hammer 122. A connecting means 130 (such as a connecting rod or rods) rigidly connects the first hammer 120 to the second hammer 122. The shunt 110 is an eccentric disc and hence includes a protrusion 112 which contacts the hammers 120 and 122 during use to drive them between positions. Each stage 190 in the jarring device 100 of FIG. 3 is rotated by 90 degrees with respect to its neighbouring stages 190. The jarring device 100 comprises an inner string 142 and a sleeve 144 which are co-axial shafts connected in line with the string 14. The inner string 142 is rotatable with respect to the sleeve 144 and carries the shunt 110, and the sleeve 144 carries the first hammer 120 and second hammer 122.

Figure 4:
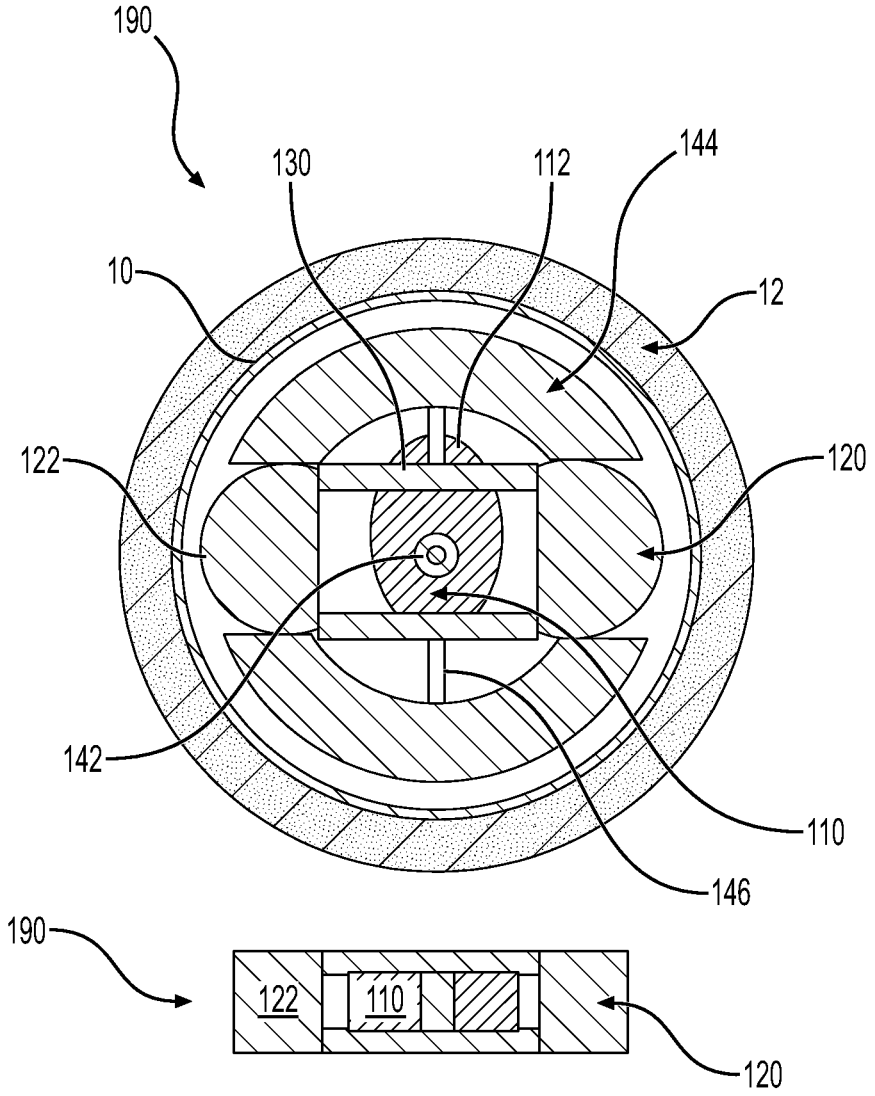
FIG. 4 is a schematic view of a stage of the jarring device of FIG. 3 with a first hammer and a second hammer in respective first positions.
Figure 5:
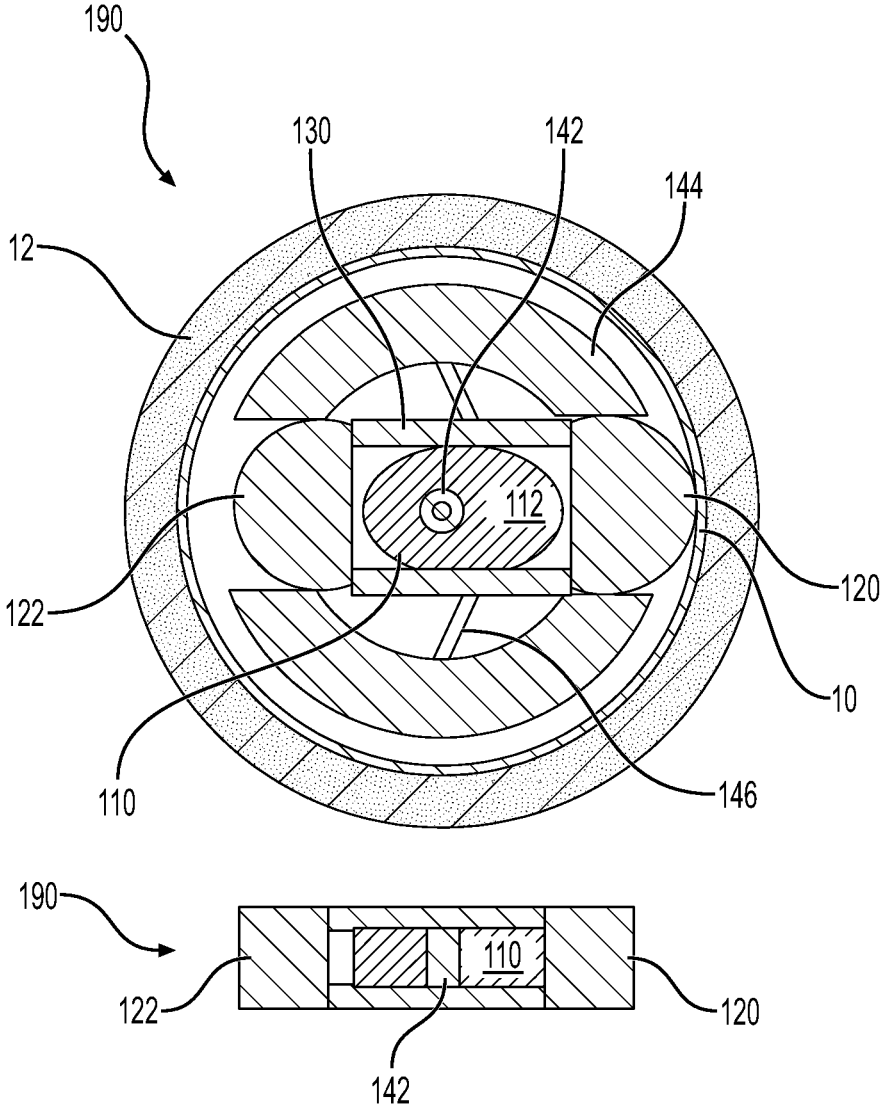
FIG. 5 is a schematic view the stage of FIG. 4 with the first hammer in a second position.
Figure 6:
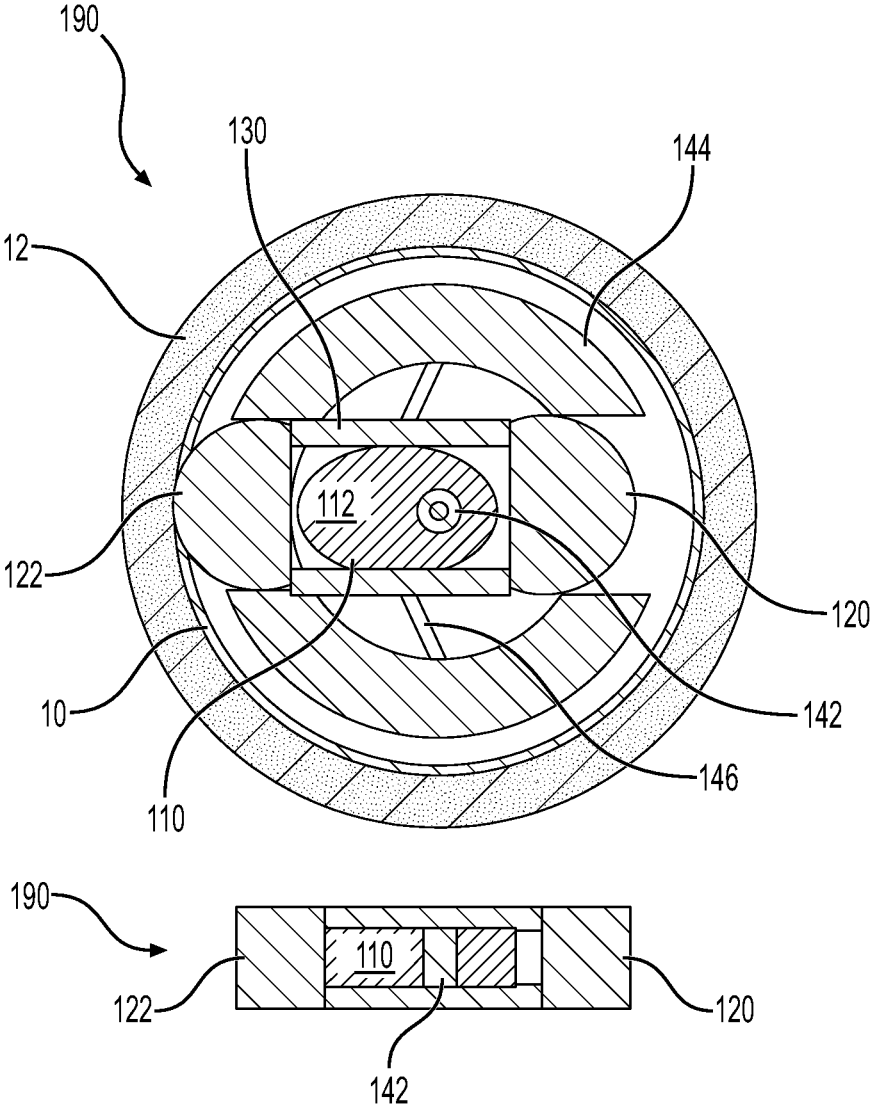
FIG. 6 is a schematic view of the stage of FIGS. 4 and 5 with the second hammer in a second position.

FIGS. 4 to 6 show a single stage 190 of the jarring device 100 at sequential moments of operation as the shunt 110 is rotated in a clockwise orientation by rotation of the inner string 142 to drive the first hammer 120 and the second hammer 122 alternately.

FIG. 4 shows the stage 190 of the jarring device 100 with the first hammer 120 and the second hammer 122 in their respective first positions, each spaced from the casing 10. The shunt 110 is carried and rotated by the inner string 142, and in FIG. 4 its protrusion 112 is not contacting either hammer. The sleeve 144 supports the first and second hammers 120, 122 within openings therein so that they can move back and forth when driven by the shunt 110. Both the first hammer 120 and the second hammer 122 are spaced from the casing 10 so that in the depicted case neither hammer is applying a force to the casing 10.

As an aside, the depicted arrangement of FIG. 4 is the neutral, or run-in-or-out, position of the stage 190 i.e. the position used for running the jarring device 100 along the casing 10.

FIG. 5 shows the stage 190 of FIG. 4 when the shunt 110 has been rotated with respect to its position in FIG. 4 so that its protrusion 112 has contacted the first hammer 120 and driven the first hammer 122 to impact the casing 10. Rotation of the shunt 110 is driven by rotation of the inner string 142. The first hammer 120 is therefore shown in its second position contacting the casing 10 in FIG. 5. The first hammer 120 is mechanically and rigidly connected to the second hammer 122 by the connecting means 130. As such, as the shunt 110 drives the first hammer 120 the second hammer 122 is also moved (to the right in the orientation shown in FIGS. 4 to 6). Therefore, the impact of the first hammer 120 with the casing 10 carries the momentum of both the first hammer 120 and the second hammer 122. Thus in the depicted case a greater impact is applied to the casing 12 than would be the case if only the first hammer 120 were driven by the shunt 110 and the second hammer 122 were stationary. Since the second hammer 122 is mechanically and rigidly connected to the first hammer 120 by the connecting means 130, the second hammer 122 has moved to a third position in FIG. 5 in which it is spaced further from the casing 10 than in its first position. It will be appreciated that any suitable connection between the first hammer 120 and the second hammer 122 may act to couple the movement of the first hammer 120 and the second hammer 122 so as to combine their momentum for impacting the casing 10 when either the first hammer 120 or the second hammer 122 is driven by the shunt 110.

After the impact depicted in FIG. 5 of the first hammer 120 with the casing 10 the shunt 110 will continue to rotate in a clockwise direction (according to the orientation shown in FIGS. 4 to 6). A biasing means (shown schematically with numeral 146) urges the first hammer 120 to return to its first position in which it is spaced from the casing 10. The second hammer 122 moves synchronously with the first hammer 120, and both hammers returned to their respective first positions the same as depicted in FIG. 4.

FIG. 6 shows the case when the shunt 110 is rotated so as to drive the second hammer 122 by contact with the protrusion 112 into the casing 10. Second hammer 122 thus applies an impact to the casing 10. The first hammer 120 is moved with the second hammer 122 because of the connecting means 130 therebetween. As such the impact of the second hammer 122 with the casing 10 carries the momentum of both the first hammer 120 and the second hammer 122. In the case depicted in FIG. 6 the second hammer 122 is in its second position contacting the casing 10 in the first hammer 120 is in its third position spaced further from the casing 10 than its first position.

FIGS. 4 to 6 depicts a schematic arrangement in which rotation of the shunt 110 alternately drives the first hammer 120 and the second hammer 122 to impact the casing 10. The impact of the hammers 120, 122 can be sufficiently forceful to crush fill 12 surrounding the casing 10 while not being so forceful as to break the casing 12. Repeated rotation of the shunt 110 causes the hammers 120, 122 to repeatedly move back in fore and repeatedly apply impacts to opposite sides of the casing 10.

Returning to FIG. 3, the jarring device 100 comprises a plurality of stages 191 to 198 each rotated by an angle of 90° with respect to its neighbouring stages. The hammers 120 and 122 of stage 191 will move left and right (in the orientation shown in FIG. 3) applying lateral forces to the left hand side and right-hand side of the casing 10. The stage 192 is oriented at 90° with respect to the stage 191 and as such the first hammer 120 and the second hammer 122 will move in use forwards and backwards (i.e. into and out of the page in the orientation shown in FIG. 3) to apply impacts to the casing 10 at an angle of 90° as compared to the impacts of the first stage 191.

The third stage 193 is rotated by an angle of 90° with respect to its neighbouring stages 192 and 194. The third stage 193 is therefore aligned with the first stage 191 but is driven by its shunt 110 half a rotation out of phase. As such during use the second hammer 122 of the third stage 193 impacts the casing 10 on the right-hand side at the same time as the first hammer 120 of the first stage 191 impacts the casing 10 on the left-hand side.

The fourth stage 194 is rotated by 90° with respect to the third stage 193 and is aligned with the second stage 192. The fourth stage 194 is driven half a rotation out of phase compared to the second stage 192. In the case depicted in FIG. 3 the first hammer 120 of the second stage 192 will contact the casing 10 on the reader's side of the figure (i.e. out of the page) whereas the second hammer 122 (not shown) of the fourth stage 194 will contact the casing 10 behind the jarring device 100 (i.e. into the page) in the orientation shown in the figure. The fifth to eighth stages 195 to 198 are oriented the same as the first to fourth stages 191 to 194 respectively.

The jarring device 100 may therefore be used to apply lateral impacts around the inside of the casing 10. In the exemplary case shown in FIG. 3 jarring impacts are applied to the casing 10 at 90° angles around the inside. It will be appreciated that any suitable number of stages 190 may be provided in the jarring device 100 as required and further that the stages 190 may be oriented by any suitable angle with respect to each other.

It will also be appreciated that the connection means 130 may be omitted from the jarring device 100 and that any suitable number of hammers may be provided per stage 190 and spaced about the shunt 110 separated by any suitable angle(s) between them.

By way of example, the first hammer may have a mass of about 25 kg and may move at a speed of about 10 meters per second when driven by the shunt. This may give a non-elastic impact of 250,000 N (kgm/s$^2$) with the casing 10. The hammer travel distance may be in the range about 30-40 mm to achieve this force. Other masses, forces and travel distances may be used and may be determined on a case-by-case basis for each wellbore and casing.

The invention claimed is:

1. A jarring device for applying an impact to a casing of a wellbore in a subterranean or subsea formation, the jarring device comprising:

a hammer; and a driving means for driving the hammer between a first position in which the hammer is spaced from the casing and a second position in which the hammer contacts the casing, such that the driving means is operable during use to drive the hammer from the first position to the second position so as to impact the casing, wherein the hammer is reciprocated by the driving means, and wherein the driving means is a shunt arranged to impact the hammer and thereby directly drive the hammer from the first position to the second position.

2. The jarring device as claimed in claim 1, further comprising a body wherein the hammer moves relative to the body when the hammer is driven from the first position to the second position.

3. The jarring device as claimed in claim 1, further comprising:

a rotatable inner shaft, wherein the shunt is supported by the inner shaft, and wherein the inner shaft is arranged such that rotation thereof causes rotation of the shunt thereabout to cause the shunt to drive the hammer from the first position to the second position; and a sleeve disposed about the rotatable inner shaft, wherein the hammer is supported by the sleeve.

4. The jarring device as claimed in claim 1, wherein the driving means is a hydraulic, mechanical, or electromechanical actuator.

5. The jarring device as claimed in claim 1, further comprising a biasing mechanism arranged to bias the hammer to the first position and to return the hammer to the first position from the second position.

6. The jarring device as claimed in claim 1, wherein the hammer is a first hammer and the jarring device comprises a second hammer movable between a first position in which the second hammer is spaced from the casing and a second position in which the second hammer contacts the casing.

7. The jarring device as claimed in claim 6, further comprising a connection which connects the first hammer and the second hammer so that movement of either the first hammer or the second hammer causes the other of the first hammer and the second hammer to move synchronously therewith, wherein the driving means is operable to drive the second hammer from the first position in which the second hammer is spaced from the casing and the second position in which the second hammer contacts the casing.

8. The jarring device as claimed in claim 1, wherein the hammer is a first stage hammer and the jarring device comprises a second stage hammer movable between a first position in which the second stage hammer is spaced from the casing and a second position in which the second stage hammer contacts the casing, and wherein the driving means is a first driving means and the device comprises a second driving means operable to move the second stage hammer from its first position to its second position.

9. The jarring device as claimed in claim 1, wherein the hammer and the driving means comprise a stage, and wherein the jarring device comprises a plurality of stages.

10. An apparatus for removing a casing from a wellbore, comprising:

the jarring device as claimed in claim 1, wherein the jarring device is disposed on a string; and a spear disposed on the string above the jarring device.

11. The apparatus as claimed in claim 10, further comprising a longitudinal jarring device arranged to provide jarring along the string in a longitudinal direction of the wellbore.

12. The apparatus as claimed in claim 10, further comprising a controller configured to control operation of the jarring device.

13. A method of applying an impact to a casing of a wellbore in a subterranean or subsea formation, the method comprising:

positioning a jarring device within the casing, the jarring device comprising a hammer and a driving means for driving the hammer between a first position in which the hammer is spaced from the casing and a second position in which the hammer contacts the casing; and operating the driving means to impact the hammer and thereby directly drive the hammer from the first position to the second position to apply an impact to the casing, wherein the hammer is reciprocated by the driving means.

14. The method as claimed in claim 13, wherein the driving means comprises a shunt, and wherein operating the shunt comprises rotating the shunt about an inner shaft to cause the shunt to drive the hammer from the first position to the second position.

15. The method as claimed in claim 13, further comprising repeatedly applying impacts to the casing by driving the hammer, and changing the frequency of impacts by changing how frequently the hammer is driven by the shunt.

16. The method as claimed in claim 13, further comprising, after applying an impact to the casing, moving the jarring device within the casing to apply an impact to another part of the casing.

17. A method of removing a casing from a wellbore in a subterranean or subsea formation, the method comprising:

applying an impact to the casing using the method as claimed in claim 13; and applying a force to the casing to pull the casing from the wellbore.

18. The method as claimed in claim 13, further comprising breaking up material surrounding the casing, wherein the material is cement.

* * * * *